US005251367A

United States Patent [19]

Ward et al.

[11] Patent Number: 5,251,367

[45] Date of Patent: Oct. 12, 1993

[54] PNEUMATICALLY DRIVEN DESCALING TOOLS

[75] Inventors: James E. Ward, Glendora, Calif.; Leo Swan, Jefferson, Md.

[73] Assignee: Equipment Development Company, Inc., Frederick, Md.

[21] Appl. No.: 905,369

[22] Filed: Jun. 29, 1992

Related U.S. Application Data

[63] Continuation-in-part of Ser. No. 747,968, Aug. 21, 1991, Pat. No. 5,184,382.

[51] Int. Cl.[5] ..... B21C 43/00

[52] U.S. Cl. ..... 29/81.15; 29/81.16; 173/168; 173/169

[58] Field of Search ..... 29/81.11, 81.12, 81.13, 29/81.15, 81.16, 81.17; 173/168, 169, 132, 133, 138

[56] References Cited

U.S. PATENT DOCUMENTS

| | | | |
|---|---|---|---|
| 1,238,255 | 8/1917 | Burkel | 173/168 X |
| 2,136,595 | 11/1938 | Rogers . | |
| 2,356,314 | 8/1944 | Gray et al. . | |
| 3,150,888 | 9/1964 | Parker | 29/81.14 X |
| 3,349,461 | 10/1967 | Niedzwiecki | 29/81.14 |
| 3,451,490 | 6/1969 | Troike | 29/81.14 X |
| 3,571,874 | 3/1971 | Von Arx . | |
| 3,680,643 | 8/1972 | Cameron et al. | 29/81.14 X |
| 3,811,514 | 5/1974 | Blomberg et al. | 173/169 |
| 3,949,944 | 4/1976 | Bent | 173/169 X |
| 4,134,193 | 1/1979 | Lenzin et al. | 29/81.14 |
| 4,321,722 | 3/1982 | Klocke . | |
| 4,632,190 | 12/1986 | Mikiya | 29/81.14 X |
| 4,723,610 | 2/1988 | Dummermuth et al. | 29/81.14 X |

FOREIGN PATENT DOCUMENTS 251913 5/1926 United Kingdom .

*Primary Examiner*—Timothy V. Eley

*Attorney, Agent, or Firm*—Birch, Stewart, Kolasch & Birch

[57] ABSTRACT

A pneumatically driven impact type set of tools including a plurality of interchangeable components having, in addition to a manually gripped housing, a common pneumatically driven reciprocating piston actuator assembly, an interchangeable set of tool heads having respectively different types of work tools associated therewith, a removable hand actuated pneumatic valve and one or more extension members which may be selectively coupled between the housing and pneumatic valve. One form of the pneumatic valve includes a safety feature in the handle sub-assembly for preventing inadvertent actuation of the valve upon release of the handle.

22 Claims, 4 Drawing Sheets

PNEUMATICALLY DRIVEN DESCALING TOOLS

CROSS REFERENCE TO RELATED APPLICATION

This is a continuation-in-part application of U.S. Ser. No. 07/747,968 now U.S. Pat. No. 5,184,382, entitled, "Pneumatically Driven Descaling Tool" filed in the names of James E. Ward and Leo Swan on Aug. 21, 1991.

BACKGROUND OF THE INVENTION

This invention relates generally to pneumatically driven hand tools for removing paint, rust, scale or corrosion from a work surface and more particularly to a convertible hand-held pneumatically driven vibratory tool including a plurality of interchangeable tool heads which in addition to being able to be used in a descaling operation, can be used as a chipping tool or an abrader for providing a scored profile, for example, on a metal surface.

Although various techniques and forms of machines and devices are generally known for cleaning and/or abrading work surfaces and which include such devices as sanding and grinding machines as well as impact type tools which in one way or another chip, scarify, or otherwise roughen a work surface, the above referenced parent application Ser. No. 07/747,968 is directed to a pneumatically driven impact type of descaler tool comprised of a manually gripped housing having a rear portion of generally circular cross section which includes therein a pneumatically driven reciprocating piston assembly which acts as a hammer for striking a pivoted anvil which is adapted to impart energy to a descaling head oriented orthogonally with respect to the housing including the reciprocating piston assembly.

SUMMARY

It is the primary object of the present invention, therefore, to provide a further improvement in hand-held power tools.

It is another object of the invention to provide a further improvement in pneumatically driven power tools.

It is a further object of the invention to provide a further improvement in pneumatically driven impact type descaling tools for removing paint, rust, corrosion and other undesirable material from a work surface.

And it is still another object of the invention to provide an improvement in pneumatically driven descaler type of impact tools which include a plurality of interchangeable heads.

These and other objects and advantages are achieved by a pneumatically driven impact type set of tools comprised of a plurality of interchangeable components including, in addition to a manually gripped housing, a common pneumatically driven reciprocating double acting piston type tool actuator assembly, an interchangeable set of tool heads having respectively different types of work tools associated therewith, a removable hand actuated pneumatic valve and one or more extension members which may be selectively coupled between the housing and pneumatic valve. One form of the pneumatic valve includes a safety feature in the handle subassembly for preventing inadvertent actuation of the valve upon release of the handle.

BRIEF DESCRIPTION OF THE DRAWINGS

The following detailed description of the invention will be more readily understood when considered together with the accompanying drawings wherein.

DETAILED DESCRIPTION OF THE INVENTION

Figure 1:
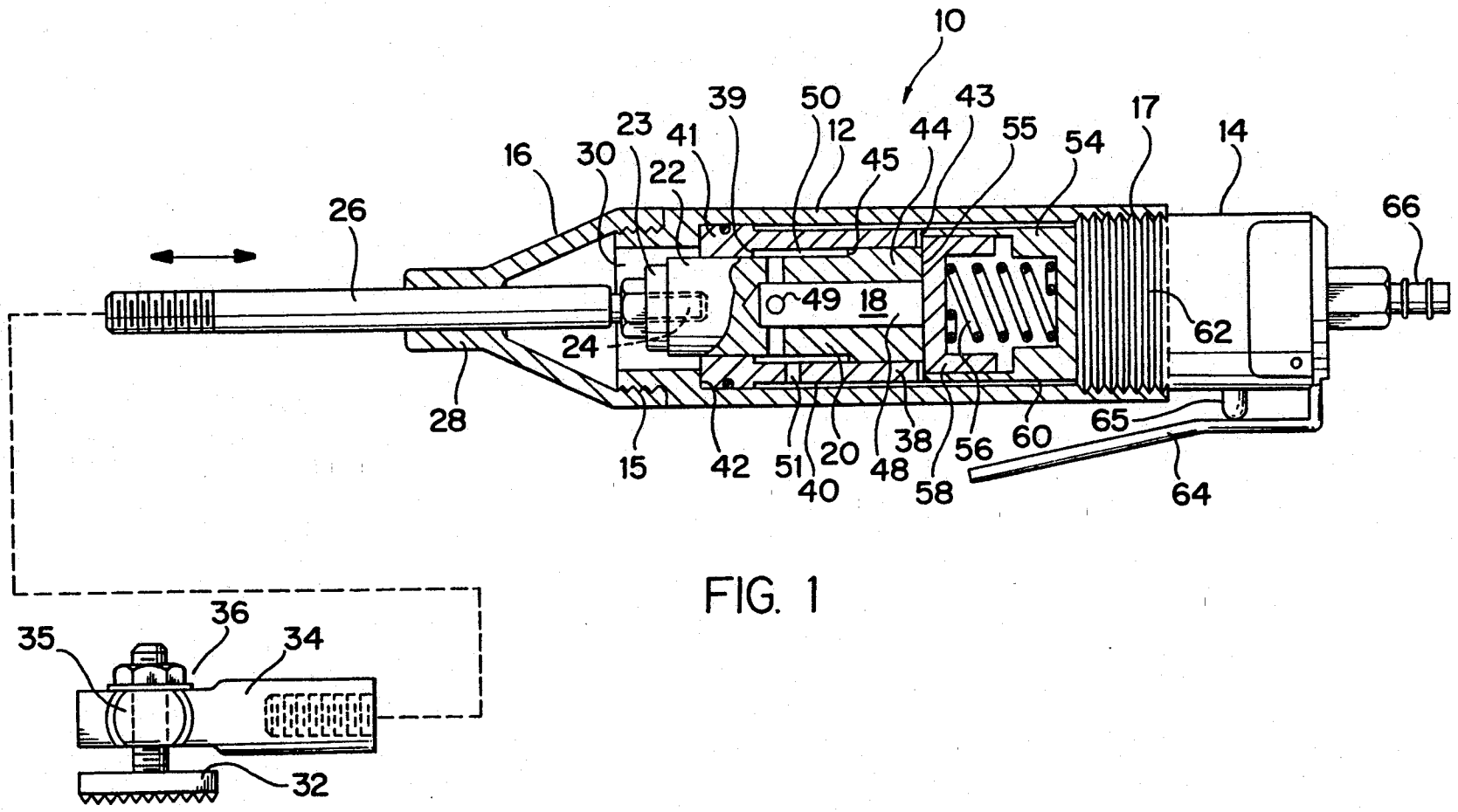
FIG. 1 is a central longitudinal cross section of a first preferred embodiment of the invention.

Referring now to the drawing wherein like reference numerals refer to like parts throughout, reference numeral 10 denotes the first embodiment of a pneumatically driven hand tool in accordance with the subject invention and one having a cylindrical housing 12 which is adapted to be manually gripped and to which is secured a threaded pneumatic valve 14 which is readily detached from the rear end of the housing 12 and which is adapted to be manually actuated by the user.

The front end of the housing 12 includes a set of male type screw threads 15 for receiving an interchangeable or convertible tool head, one of which is identified in FIG. 1 by reference numeral 16. The housing 12 also includes a set of female type screw threads at the opposite end which is shown engaging the valve 14. The housing 12 is also designed to hold a pneumatically driven tool actuator assembly 18. The assembly 18 is comprised of an elongated piston type member 20 having a forward end portion 22 including a blunted tip 23 which is threaded so as to engage the stud portion 24 of a threaded rod 26 which passes through a nose section 28. The stud 24 of the rod 26 is held in place by means of a nut and lock washer 30. At the fore end of the rod 26 is located a descaling head assembly comprised of a stud mounted descaling tool 32 which is attached to a threaded coupling member 34 via a ball joint 35 and another nut and lock washer 36.

Considering the piston portion of the assembly 18, the piston 20 is a double acting piston which is adapted to reciprocate within an outer cylinder 38 having a forward inside shoulder 39 and which is slidably inserted in an elongated axial bore including an air passage 40 where it abuts a restraining shoulder 42. The piston 20, moreover, includes a rear portion 44 including a shoulder 45 which is slightly larger than the forward body portion 22.

The piston 20, moreover, includes a central axial bore 48 and a plurality of transverse holes 49 connecting the bore 48 to an air passage 50 between the piston 20 and the outer cylinder 38. At least one connecting opening 51 links the two air passages 40 and 50. Immediately behind the piston 20 and cylinder 38 is a sub-assembly comprising a spring biased cylindrical body member 54 which is adapted to house a compression spring 56 and a movable end cap 58 which fits inside the end of the body member 54 and is adapted to receive the rear surface 55 of the piston 20 on its return stroke.

Further as shown, the valve 14 includes a set of male type screw threads 62 for attachment to the cylindrical housing 12. Also shown is a manually operated handle 64 in contact with a spring loaded valve stem 65 and an air hose attachment coupling member 66.

In operation, compressed air is supplied to the piston 20 from the valve 14 via the outside air passage 40 where it is fed into the piston bore 48 via the opening 51 and the piston holes 49. Compressed air entering the piston bore 48 drives the piston 20 forward, i.e. to the left until the openings 49 are shut off or blocked by the forward portion 41 of the outer cylinder 38 past the inside shoulder 39. At that point, compressed air in the piston bore 48 escapes from the rear surface 55 around the rear of the outer cylinder 38 at the space 43. Now, however, compressed air is fed into the opening 51 and into the air passage 50 which is now closed. By virtue of the rear shoulder portion 45 of the piston 20, it is driven rearwardly, i.e. to the right back against the compression spring 56. Thus an oscillatory motion of the piston 20 is set up which operates to axially drive the rod 26 coupled to the descaling head 32 back and forth at a very rapid rate.

When desirable, the valve 14 may be replaced by a positive acting structure as shown in FIGS. 4A–4C and 5A–5C for preventing automatic shut-off and inadvertent actuation, for example, when the tool is dropped. The details of this structure will be considered subsequently.

Figure 2:
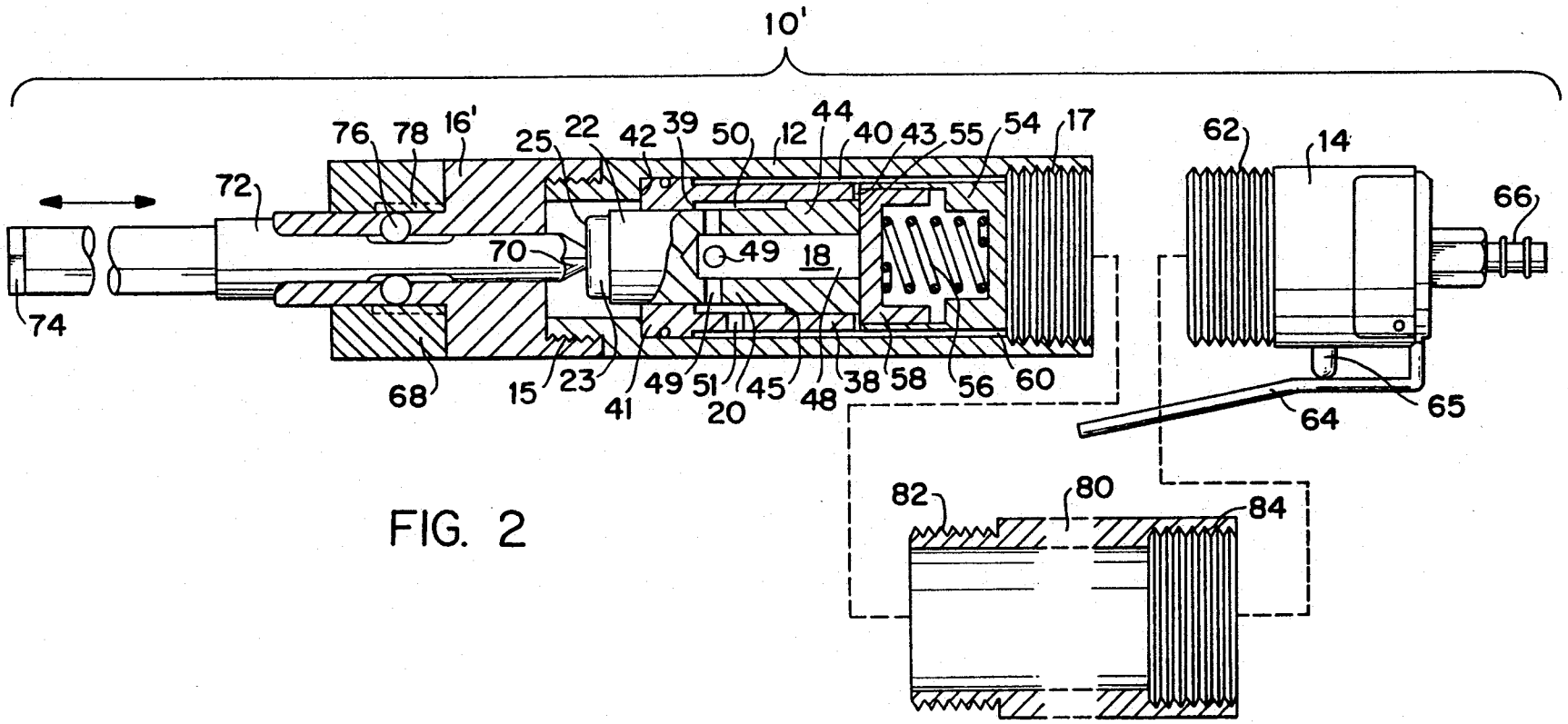
FIG. 2 is a central longitudinal cross section of a second preferred embodiment of the invention and being further illustrative of a housing extension member for increasing the length of the housing.

Referring now to FIG. 2, shown thereat is a second embodiment of the invention where there is disclosed a second type of interchangeable tool head 16′ comprised of a chuck type sub-assembly 68 which is threaded at its inner end so as to engage the set of screw threads 15 on the front of the housing 12. The piston assembly 18 is the same as that shown with respect to FIG. 1, with the exception that the tip 23 is not threaded, but now includes a flat front surface portion 25 which is adapted to contact the rear end 70 of a tool member 72 having a chisel type tip 74. The chuck 68 includes a spring loaded bearing race 76 and retaining ring 78 which permit quick removal and replacement of the tool 72. In operation, the reciprocatory motion provided by the piston assembly 18 simply drives the tool 72 axially back and forth in jack-hammer fashion when the valve 14 is actuated by squeezing the handle 64.

Further, the embodiment shown in FIG. 2 includes a cylindrical housing extension 80 of a predetermined length and having the same outer diameter as the housing 12 while having a set of male type screw threads 82 on one end for engaging the female type screw threads 17 on the rear end of the housing 12 and a set of female type threads 84 for engaging the male type threads 62 on the front of the pneumatic valve member 14. The purpose of the extension member 80 is to provide a relatively longer length tool which would facilitate its use. The embodiment of FIG. 1 furthermore is meant to illustrate the reconfigurability of the tool to fit the particular task at hand.

Figure 3:
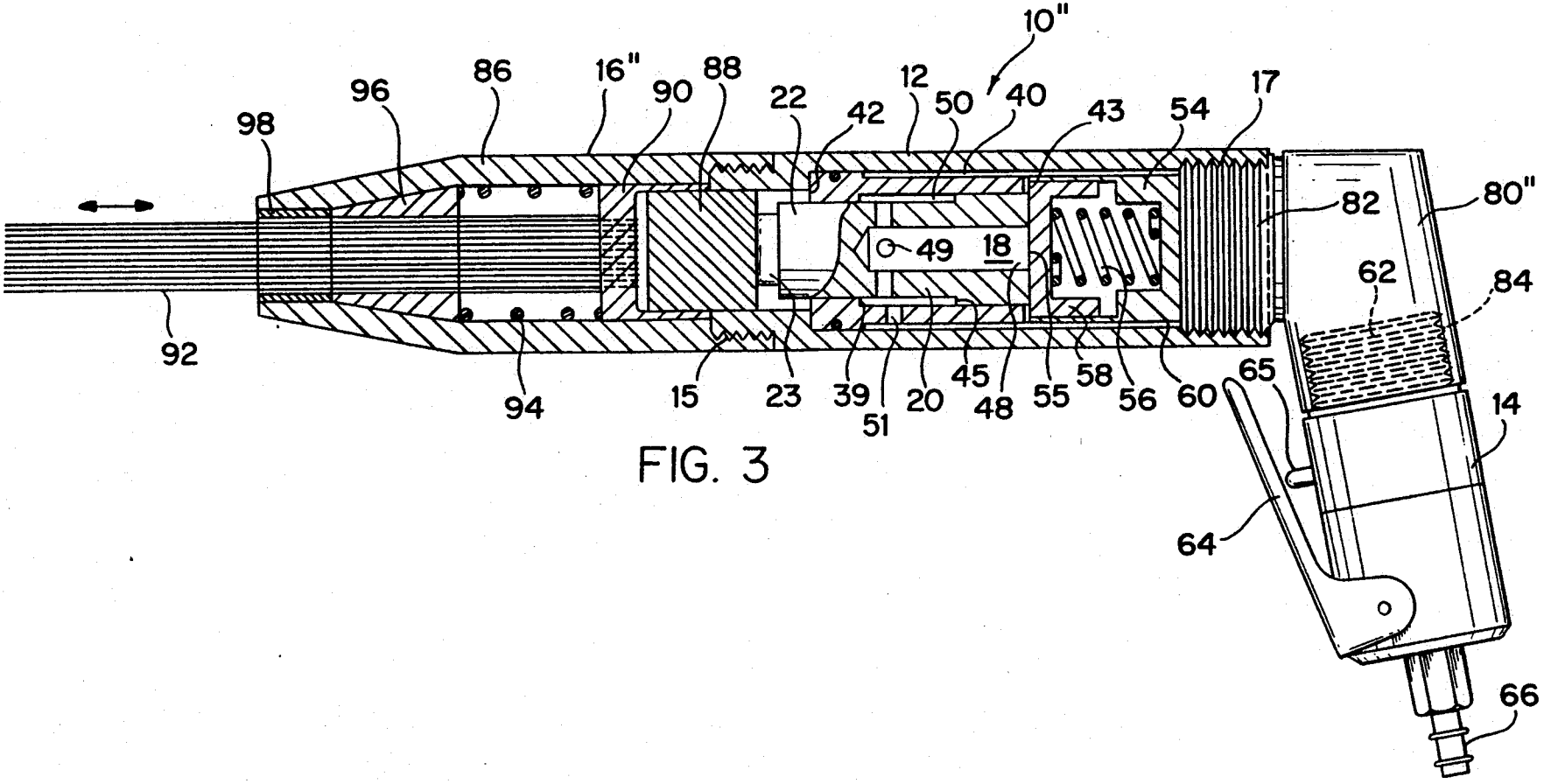
FIG. 3 is a central longitudinal cross section of a third preferred embodiment of the invention, and additionally illustrating a housing extension providing a pistol grip type of pneumatic actuator.

Considering now the embodiment shown in FIG. 3, two new parts are depicted, namely the tool head 16′ and the angled rear extension member 80′. The piston assembly 18 and the pneumatic valve 14 remain the same as utilized in connection with the embodiments shown in FIGS. 1 and 2. As to the tool head 16′, it comprises a needle type descaling unit having an elongated barrel type of member 86 which is adapted to be threadably engaged with the screw threads 15 on the front of the housing 12. The member 86 houses an anvil type plate 88 which is adapted to be struck by the blunted tip 23 of the piston 20. The anvil 88 is located inside of a wire retaining cup 90 to which is attached a plurality of elongated metallic needle members 92. The cup 90 abuts a forwardly located compression spring 94 which contacts a conically shaped abutment element 96 located in the narrowed front portion of the barrel element 86. A sleeve 98 is positioned at the outer end of the barrel 86 for providing an unobstructed passage of a predetermined size for the wire needle members 92. In operation, operation of the piston assembly 18 causes an axial reciprocatory movement of the needle members 92 which, when applied against a surface, will roughen and scarify a work surface in an intended manner.

The angulated extension member 80 provides an offset for the pneumatic valve 14 so as to provide a pistol type grip configuration for the tool 10″.

In the three embodiments of the invention shown in FIGS. 1–3, the same type of pneumatic valve 14 has been depicted, namely one having a lever type actuating handle 64 which is adapted to compress the spring biased valve stem 65. In each instance, manual squeezing of the handle 64 against the body of the valve 14 operates to actuate the respective tool by delivering compressed air from the coupling member 66 to the piston 20 of the piston assembly 18. It can be seen that by dropping any of the tools shown or inadvertently gripping the valve 14 will actuate the device.

Figure 4A:
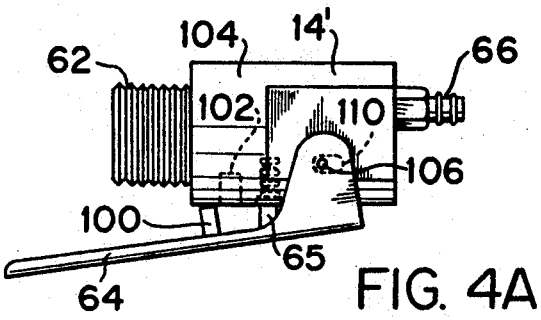
FIGS. 4A–4C depict the off condition of a positive acting pneumatic valve for the embodiments shown in FIGS. 1–3.
Figure 4B:
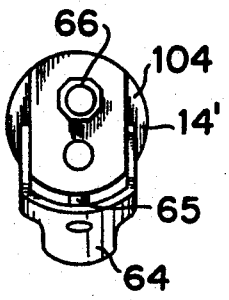
Figure 4C:
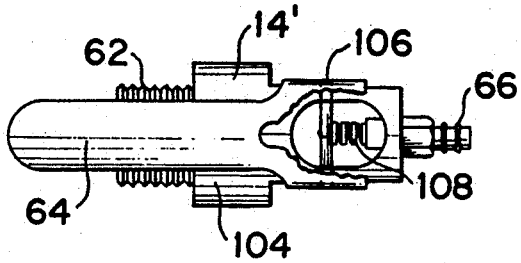
Figure 5A:
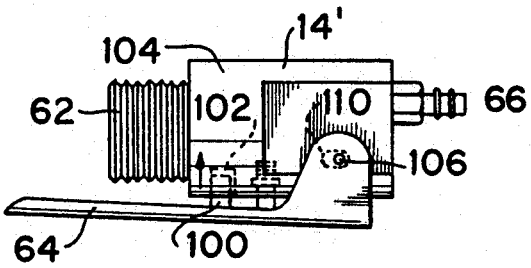
FIGS. 5A–5C depict the on condition of the pneumatic valve shown in FIGS. 4A–4C.
Figure 5B:
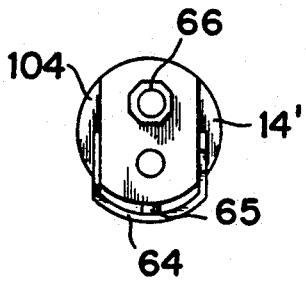
Figure 5C:
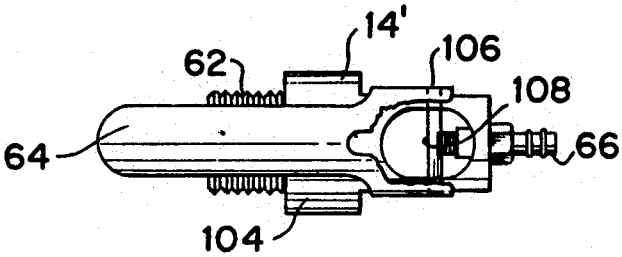

In order to provide a more positive actuation which in addition will prevent accidental turn on, the valve 14 may be replaced by a modification thereof as shown by reference numeral 14′ in FIGS. 4A–4C and FIGS. 5A–5C. The modification involves the addition of a pin 100 on the underside of the pivoted handle 64 behind the valve stem 65 and which is adapted to fit into a small bore 102 formed in the valve body 104. Additionally, the handle 64 is attached to a spring biased pivot pin 106 connected to a compression spring 108 as shown in FIGS. 4C and 5C. The pivot pin 106 is adapted to translate linearly within a small slot 110 formed in the valve body 104.

As illustrated in FIGS. 4A–4C, the valve 14′ is in its deactivated position where the spring biased valve stem 65 has caused the handle 64 to pivot downwardly to an off position. In doing so, the pin 100 is removed from the bore 102 and the bias spring 108 further causes the handle 64 to be pushed to the left, causing the pin to rest on the outer surface of the valve body 104. In such a position, the valve 14′ cannot be actuated unless the handle 64 is first pushed forward so that the pin 100 can enter the bore 102 as best shown in FIG. 5A. In the process, the compression spring 108 attached to the pivot pin 106 compresses and will remain compressed until such time as the handle 64 is released, at which time the valve will revert to the configuration as shown in FIG. 4A. Thus any accidental gripping of the valve handle 64 without it first pushing it forward will not activate the valve 14′ nor will any accidental dropping or other movement of the handle 64 cause the valve 14′ to be actuated, thereby providing a safety feature which does not exist in the valve 14, referred to heretofore.

Thus what has been shown and described is a further improvement in pneumatically driven power tools which may be utilized in a variety of different user selective configurations depending upon the particular task at hand. Having thus shown and described several different embodiments of the invention, it should be noted that the same has been made by way of illustration and not limitation and, therefore, various combinations and modifications may be resorted to without departing from the spirit and scope of the invention as set forth in the appended claims.

We claim:

1. A hand-held pneumatic impact tool, comprising:

a generally cylindrical housing sized for manual gripping and having tool component coupling means at each end for selectively attaching an interchangeable tool component thereto;

a pneumatically powered tool actuator assembly located in said housing and including a reciprocating type piston member mounted in an outer cylinder member affixed to an inner surface of said housing, an inner rear end section located between both said outer cylinder member including said piston member and said pneumatic valve, and a first air passage extending from said pneumatic valve between said inner surface of said housing and an outer surface of said inner rear end section and said outer cylinder member, said piston member further comprising a double acting piston member including a generally cylindrical body member having an enlarged rear portion facing said inner rear end section and having a peripheral surface defining a first shoulder region thereat, an axial bore in said piston member open to said inner rear end section and at least one transverse opening in said piston member at a forward section of said axial bore, said outer cylinder member having at least one opening therein in relatively close proximity to said at least one transverse opening in said piston member, and an enlarged forward portion facing said tool head and having a peripheral surface thereat defining a second shoulder region, the space between said first and second shoulder regions defining a second air passage for driving said piston member, said first and second air passages being connected by said at least one opening in said outer cylinder, whereby compressed air from said pneumatic valve is supplied via said first air passage to said bore of said piston member through said at least one transverse opening therein and said at least one opening in said outer cylinder causing the piston member to be driven in a forward direction until said at least one transverse opening is blocked by the forward portion of said outer cylinder, whereupon air being fed to said second air passage is now be supplied to said first shoulder region of said piston member driving it in a rear direction, a repetitive forward and rear motion thereby being imparted to said piston member and said work tool;

a plurality of different type detachable and interchangeable tool heads connectable to one end of said housing, each of said tool heads including a respective work tool selected from a group consisting of descaling, chipping, chiseling and abrading tools and being driven by a forward portion of said piston member; and a readily removable hand actuated pneumatic valve coupled to the other end of said housing for supplying compressed air to said tool actuator assembly for powering said piston member, whereby a set of interchangeable impact tool components can be assembled on demand to provide a plurality of tool configurations for performing a plurality of different work functions.

2. The tool according to claim 1 wherein one of said tool heads includes an elongated rod member connected between said piston member and said work tool.

3. The tool according to claim 2 wherein said work tool comprises a descaling tool.

4. The tool according to claim 2 wherein said work tool includes a coupling member attachable to a distal end of said rod member and a descaling tool secured to said coupling member.

5. The tool according to claim 4 wherein said work tool additionally includes a ball joint member located at an outer end of said coupling member.

6. The tool according to claim 5 wherein said descaling member is secured to said ball joint member.

7. The tool according to claim 5 wherein said one tool head additionally includes a nose section supporting said elongated rod member attachable to said one end of said housing.

8. The tool according to claim 1 wherein one of said tool heads comprises a chuck for holding the respective work tool.

9. The tool according to claim 8 wherein said chuck includes means for resiliently holding and releasing said work tool.

10. The tool according to claim 9 wherein said work tool comprises an elongated work tool having a proximal end positioned adjacent said piston member.

11. The tool according to claim 10 wherein said elongated work tool comprises a chisel type tool.

12. The tool according to claim 1 wherein one of said tool heads comprises a needle type descaling head.

13. The tool according to claim 12 wherein said descaling head includes, an elongated barrel type member, and a plurality of elongated parallel wire type elements attached to a spring biased movable sleeve located in said barrel type member and actuated by said piston member.

14. The tool according to claim 13 and additionally including a compression spring located within the barrel type member and contacting a forward portion of said sleeve for acting as a return spring therefor.

15. The tool according to claim 14 and additionally including an anvil type member located between said sleeve and said piston member.

16. The tool according to claim 1 and additionally including an extension member located between said housing and said pneumatic valve.

17. The tool according to claim 16 wherein said extension member comprises a generally cylindrical member having a transverse cross sectional dimension substantially equal to the transverse cross sectional dimension of said housing.

18. The tool according to claim 16 wherein said extension member comprises an angulated member for providing a pistol type grip at the valve end of the tool.

19. The tool according to claim 1 wherein said pneumatic valve includes a spring biased pivoted type of actuation handle biased to an off position and having means for preventing an undesired actuation of said valve to an on position.

20. The tool according to claim 19 wherein said valve includes a valve body, and wherein said means for preventing actuation includes, a bore in said valve body beneath said handle, a pin located on the underside of said handle and being offset from said bore in the off position, said handle further being translatable against a bias generated by a compression spring member located in said valve body to position said pin over said bore, thereby permitting said handle to be squeezed so as to permit said pin to enter said bore and enable the valve to be actuated to the on position, thereafter release of said handle causes the spring biased handle to remove said pin from said bore, whereupon the handle is translated by said compression spring to said off position where said pin is offset relative to said bore.

21. A hand-held pneumatic impact tool, comprising:

a generally cylindrical housing sized for manual gripping and having tool component coupling means at each end for selectively attaching an interchangeable tool component thereto;

a pneumatically powered tool actuator assembly located in said housing and including a reciprocating type piston member mounted in an outer cylinder member affixed to an inner surface of said housing;

a detachable tool head coupled to one end of said housing and including a work tool driven by a forward portion of said piston member;

a detachable hand actuated pneumatic valve coupled to the other end of said housing for supplying compressed air to said tool actuator assembly for powering said piston member, said pneumatic valve being comprised of a valve body and a spring biased pivoted type of actuation handle biased to an off position and further having means for preventing an undesired actuation of said valve to an on position, and wherein said means for preventing actuation comprises, a bore in said valve body beneath said handle, a pin located on the underside of said handle and being offset from said bore in the off position, said handle further being translatable against a bias generated by a compression spring member located in said valve body to position said pin over said bore, thereby permitting said handle to be squeezed so as to permit said pin to enter said bore and enable the valve to be actuated to the on position, thereafter release of said handle causes the spring biased handle to remove said pin from said bore, whereupon the handle is translated by said compression spring to said off position where said pin is offset relative to said bore.

22. A hand-held pneumatic impact tool, comprising:

generally cylindrical housing sized for manual gripping aid having tool component coupling means at each end for selectively attaching an interchangeable tool component thereto;

a pneumatically powered tool actuator assembly located in said housing and including a reciprocating type piston member mounted in an outer cylinder member affixed to an inner surface of said housing;

a detachable tool head coupled to one end of said housing and including a work tool driven by a forward portion of said piston member;

a detachable hand actuated pneumatic valve coupled to the other end of said housing for supplying compressed air to said tool actuator assembly for powering said piston member, said tool head further including an elongated rod member connected between said piston member and said work tool, and wherein said work tool includes a coupling member attachable to a distal end of said rod member and a descaling tool secured to said coupling member.

* * * * *